United States Patent [19]

Campen

[11] Patent Number: 4,712,521

[45] Date of Patent: Dec. 15, 1987

[54] IGNITION SYSTEM

[75] Inventor: Kenneth W. Campen, Kiel, Wis.

[73] Assignee: Tecumseh Products Company, Tecumseh, Mich.

[21] Appl. No.: 3,851

[22] Filed: Jan. 15, 1987

[51] Int. Cl.[4] ..... F02P 1/00; F02B 77/00

[52] U.S. Cl. ..... 123/149 C; 123/198 D; 123/599

[58] Field of Search ..... 123/149 C, 198 D, 599, 123/604

[56] References Cited

U.S. PATENT DOCUMENTS

| | | | |
|---|---|---|---|
| 2,250,754 | 7/1941 | Dooley . | |
| 3,484,677 | 12/1969 | Piteo . | |
| 3,718,128 | 2/1973 | Botker | 123/179 K |
| 3,838,748 | 10/1974 | Gray et al. | 180/82 C |
| 4,036,201 | 7/1977 | Burson | 123/148 CC |
| 4,233,950 | 11/1980 | Krolski et al. | 123/630 |
| 4,236,494 | 12/1980 | Fairchild | 123/630 |
| 4,369,745 | 1/1983 | Howard | 123/198 DC |
| 4,449,497 | 5/1984 | Wolf et al. | 123/599 X |
| 4,531,500 | 7/1985 | Burson | 123/630 |

*Primary Examiner*—Allen M. Ostrager

*Attorney, Agent, or Firm*—Jeffers, Hoffman & Niewyk

[57] ABSTRACT

A breakerless electronic ignition system including a permanent magnet assembly, a transformer, an electronic ignition circuit and a cut off switch. In one embodiment of the system, a charging coil charges up a capacitor. The capacitor is connected in series with an electronic switching device and a primary coil of the transformer. The transformer primary coil has one end connected to the cut off switch which is normally closed and which is connected to ground. When the cut off switch is in the open position, current is prevented from flowing through the primary coil whereas the electronic switching device continues to be triggered as the engine coasts to a stop. In an inductive embodiment of the system, the primary coil of the transformer is also lifted from ground by the cut off switch to stop further generation of ignition sparks.

14 Claims, 4 Drawing Figures

IGNITION SYSTEM

BACKGROUND OF THE INVENTION

This invention relates to breaker less ignition systems and more particularly to a breakerless ignition system including a shut off switch and grounding connections for the system.

Breakerless ignition systems have become commonplace in recent years for use with small internal combustion engines such as lawn mowers, chain saws, and the like. Such systems are generally quite compact and consist of a housing in which both the coils of the system and the elecrtronic control circuit, therefore, are potted or encapsulated. For the sake of economy and ease of fabrication, as few connections should be made to the system as are possible. The systems generally include a ferromagnetic core and a permanent magnet assembly which is rotatably mounted to move cyclically past the core and to induce voltages in the coils which are mounted on the ferromagnetic core. Additionally, the systems generally include an electronic switching device for providing control of the current in a primary coil of a transformer arrangement whereby when current is conducted through the primary coil, a high voltage will be generated in a secondary coil which is used to generate a spark in a spark gap device connected to the seconday coil.

Two types of breakerless electronic ignition switching systems have been used, namely, capacitor discharge-type systems and inductive type systems. U.S. Pat. No. 4,036,201 discloses a capacitor discharge ignition system wherein a capacitor is charged by the voltage generated across a charging coil and wherein the capacitor is periodically discharged through an electronic switching device to generate a high discharge voltage pulses in the transformer secondary coil. U.S. Pat. Nos. 3,484,677 and 4,270,509 disclose inductive types of systems for generating high discharge voltage pulses in a transformer secondary coil. In most of the above identified patented systems, the primary coil, the secondary coil and the ignition circuit components are wired together and a single common ground connection is employed. Additionally, a shut off switch is provided for the electronic circuit whereby the charging circuit is rendered inoperative when the shut off switch is closed and whereby either the charging coil or the control coil are connected to ground.

Requirements for equipment incorporating breakerless ignition circuits often require that the equipment is provided with a "dead man" cut off system whereby, when the operator releases the controls of the equipment, the ignition will be quickly cut off and the engine will, therefore, stop. However, if for any reason a common ground terminal connections has been broken in the ignition systems disclosed in the above-identified patents, it is possible that the ignition system would continue to generate ignition pulses and that teh engine would not stop if the shut off switch were closed. Such failure of the cut off mechanism results from the presence of circuit connections within the circuit module so that a complete and operative circuit still exists even though the ground connection has become disconnected.

U.S. Pat. No. 4,531,500 discloses an ignition cut off system which will not be rendered ineffective in the event of a break in the ground terminal connection. In the disclosed system, one end of the primary coil is grounded separately. Further, a separate grounding connection is provided for the electronic switching circuit. In addition, a shut off switch is provided which prevents further ignition pulses from being generated when the shut off switch is in the closed positon. However, in this system, if the found connection to the shut off switch is broken for any reason, the ignition circuit would continue to operate even with the shut off switch in the closed position and the engine could therefore not be shut off. Furthermore, in the disclosed circuit, two separate grounding connections must be made to the grounding lugs located on the transformer core. One of these connections is for the primary coil, the other connection is for the electronic ignition circuit. A separate lead must be brought out from the system for connection to a shut off switch, it is, therefore, desired to provide a simple ignition system wherein a minimum of external connections are made to the ignition wherein the primary coil of the electronic ignition system is opened by the shut off switch to deenergize the system while permitting the electronic switching device to operate as the engine coasts to a stop.

Still another electronic ignition system is disclosed in U.S. Pat. No. 4,236,494, wherein the triggering circuit for the electronic switching device has been grounded by means of a safety switch. This switch is normally in the closed position so that, when the operator releases the controls of the equipment, triggering energy will no longer by supplied to the electronic switching device whereby the engine will shut off. A disadvantage of this system is that when the triggering circuit is opened, the electronic switching device will no longer function. however, since the engine does not stop instantaneously, further high voltages will be generated by the charging circuit. To prevent excessive voltages from being developed, this system has been provided with a bleed off device to remove the excess voltages from the circuit, thus adding further cost. It is, therefore, desired to provide an electronic ignition system wherein no such bleed off devices are necessary.

SUMMARY OF THE INVENTION

The present invention overcomes the disadvantages of the above-described prior art electronic ignition systems by providing an improved electronic ignition system therefor.

The electronic ignition circuit of the present invention, in one form thereof, comprises a circuit wherein one side of the primary coil is connected to ground by means of a cut off switch. Additionally, a ground connection is provided for the electronic ignition circuit. Thereofre, when the cut off switch is in the closed position, current flow through the primary coil is enabled and the circuit is operable. However, when the cut off switch is opened, further current flow through the primary coil is prevented. The electronic switching device, however, remains operative as the engine coasts to a stop whereby the voltages generated in the circuit will be bled off by means of appropriate circuit connections.

The present invention, in one form thereof, provides a ferromagnetic core upon which are mounted a charging coil, a primary coil, and a secondary coil. The primary coil and secondary coil are inductively coupled by the ferromagnetic core. An electronic switching device is connected in series with the primary coil whereby voltages induced in the charging coil generate current flow through the primary coil when the electronic switching device is turned on. One end of the primary coil is connected to a cut off switch which in turn is connected to ground. In the normally closed position of the cut off switch current surges through the primary coil and induce high voltage surges in the secondary coil which cause sparks to be generated in a spark gap device connected across the secondary coil. the ignition circuit is grounded by means of a connection to the ferromagnetic core. The cut off switch is connected to ground at a position remote from the ferromagnetic core.

One advantage of the electronic ignition system according to the present invention is that it is fail safe since a break in one of the grounding connections will cause the circuit to be inoperative.

A further advantage of the electronic ignition system according to the present invention is that is is a very simple system as only a single connection needs to be brought out from the circuit for connection to the cut off switch.

Still another advantage of the circuit according to the present invention is that current flow through the primary coil is interrupted by the cut off switch whereby voltages generated in the ignition circuit when the cut off switch is operated and the engine coasts to a stop are dissipated since the electronic switching device continues to operate.

The present invention, in one form thereof, comprises an electronic ignition system for an internal combustion engine. The system includes a ferromagetic core and a plurality of coils mounted on the core. The plurality of coils includes a primary coil, and a secondary coil which is inductively coupled to the primary coil by the core. A permanent magnet is rotatably mounted for movement past the core to induce varying flux densities therein. An electronic switching circuit is connected to the primary coil to control the current flow therethrough. The electronic switching circuit includes an electronic switching device and a capacitor which is charged by the voltage developed by the movement of the permanent magnet in one of the plurality of coils. The capacitor is discharged through the electronic switching device. A first ground connection is provided for the electronic switching circuit and a second ground connection is provided for the primary coil. A cut off switch is connected between one end of the primary coil and the second ground connection whereby, when the cut off switch is opened, current flow through the primary coil is prevented and the electronic switching device continues to operate to discharge electric charge stored in the capacitor.

The present invention, in one form thereof, further provides an electronic ignition system for an internal combustion engine including a core of ferromagnetic material. A permanent magnet is adapted to move past the core to induce cyclically varying magnetic flux therein. A primary coil, a secondary coil and a charge coil are mounted on the core. An electronic switching circuit is connected in circuit with the charging coil and the primary coil for providing controlled current flow through the primary coil. A first ground connection is provided for the electronic switching circuit. A cut off switch has one side thereof connected to the primary coil and the other side thereof connected to a second ground connection, whereby current flow throgugh the primary coil is prevented when the cut off switch is open.

The present invention, in one form thereof, still further provides an electronic ignition system for use with an internal combustion engine. The system includes an electronic switching circuit having an electronic switchign device and a storage capacitor connected therein. A core of ferromagnetic material is provided and a charging coil is mounted on the core. The charcing coil is connected in circuit with the electronic switching device. A first grounding connection for the electronic switching circuit is provided on the core. A transformer is provided including a ferromagnetic core, a primary coil, and a secondary coil. The secondary coil is adapted for connection to a spark gap device and the primary coil is connected in series with the electronic switching device. A first grounding connection on the core is provided or the electronic switching circuit. A cut off switch is provided which has one end connected to a second ground conneciton located remotely from the core. The switch has a second end connected to the primary coil. Therefore, when the cut off switch is in the open position, current flow in the primary coils is interrupted while the electronic switching device will continue to operate to discharge the storage capacitor as the engine coasts to a stop.

It is an object of the present invention to provide an electronic ignition system which is simple and inexpensive to manufacture.

It is a further object of the present invention to provide an electronic ignition system which is fail safe.

It is a further object of the present invention to provide an electronic switching system wherein the primary coil is grounded by way of a cut off switch which is normally in the closed position.

BRIEF DESCRIPTION OF THE DRAWINGS

The above-mentioned and other features and objects of this invention and the manner of attaining them will become more apparent and the invention itself will be better understood by reference to the following description of an embodiment of the invention taken in conjunction with the accompanying drawings wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figure 1:
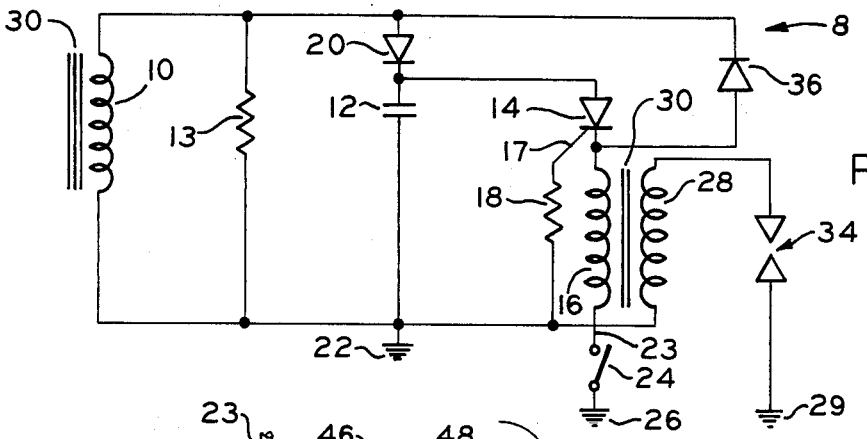
FIG. 1 is a schematic wiring diagram showing a capacitor discharge ignition system which embodies the invention.
Figure 2:
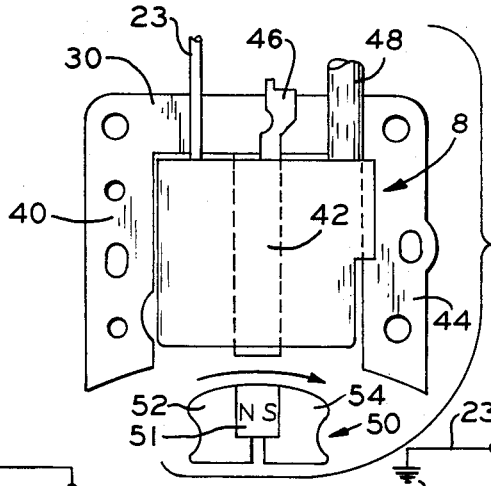
FIG. 2 is an elevational view of a magneto embodying the present invention with the permanent magnet assembly shown schematically.

Referring now to FIGS. 1 and 2, a capacitive discharge ignition system 8 is shown including a charge coil 10, a storage capacitor 12, and a resistor 13 which is connected in parallel with charge coil 10. An SCR (Silicon Controlled Rectifier) 14 is connected in parallel circuit with capacitor 12. The SCR is in series connection with a primary coil 16. The SCR includes a gate 17 which is connected by means of resistor 18 to the other side of capacitor 12. A diode 20 is connected in series with charge coil 10 and capacitor 12. The entire ignition circuit is grounded by means of a ground 22. Primary coil 16 has one end directly connected to ground 26 by means fo a switch 24 which, in its closed position, makes the circuit operative. The connecting lead between primary coil 16 and switch 24 is labeled 23. A secondary coil 28 is shown which is inductively coupled to primary coil 16 by means of a transformer or stator core 30. The core, as is conventional, may be comprised of ferromagnetic laminations which are joined together in a stack. A spark gap device 34 is connected in series across secondary coil 28 by way of ground connection 29. A diode 36 connects the cathode of SCR 14 to one side of charge coil 10.

Referring now to FIG. 2, the ignition system 8 is shown physically as an encapsulated or potted structure which preferably is housed in a plastic or other suitable housing. Transformer or stator core 30 is shown to include three legs 40, 42, and 44, with the coils 10, 16, and 28, mounted on the center leg 42. A ground tab 46 is connected to core 30 whereby the grounding connection 22 of FIG. 1 may be made to core 30. Lead 23 is supplied from circuit 8 for connection to one side of the external cut off switch 24. Thus, in the use of electronic ignition system 8 with an internal combustion engine, switch 24 may comprise a seat operated switch, a hand operated switch or the like. A high tension wire 48 leads from the encapsulated electronic ignition system 8 to a spark gap device 34 such as a conventional spark plug. Schematically shown in FIG. 2 is the magnet assembly 50 including a permanent magnet 51 which is sandwiched between two pole shoes 52 and 54. For further description of the permanent magnet structure and the mounting arrangement thereof to a flywheel, reference may be had to U.S. Pat. Nos. 4,550,697 and 4,606,305 which are assigned to the assignee of the present invention and which descriptions are incorporated herein by reference.

In operaion, the circuit of FIG. 1 operates as follows. Rotating magnet assembly 50 generates varying flux densities in core 30, thereby generating alternative voltage pulses in charge coil 10. These voltage pulses will cause capacitor 12 to be charged on positive half cycles. During the negative half cycle, capacitor 12 will not be charged due to the action of blocking diode 20. However, the voltage induced in primary coil 16 by the movement of magnet assembly 50 past core 30 causes SCR 14 to be triggered on by the voltage generated in the circuit including primary coil 16, charge coil 10, resistor 18, and gate 17. Thus, capacitor 12 will discharge the stored energy through SCR 14 and normally closed switch 24 to ground 26. The current pulse which flows through primary coil 16 will induce a high voltage pulse in secondary coil 28, thus generating a spark across spark gap device 34.

However, if switch 24 is opened, capacitor 12 cannot discharge through primary coil 16 as no continuous discharge circuit is available from capacitor 12 through SCR 14 and coil 16. In that case, no high voltage pulses will be generated in secondary coil 28 and no sparks will be generated in spark gap device 34. A continuous circuit does exist through SCR 14, diode 36, and charge coil 10 for discharging capacitor 12. However, since no current flows through coil 16, no spark is generated across spark gap device 34 and the engine will, therefore, be deenergized and will not run.

It should be noted that, in case of a break in the grounding system, either in ground connection 22 or in ground connection 26, the circuit will be inoperative. This provides a fail-safe feature for the system as compared to many prior art ignition systems so that the engine is inoperative if a break in the grounding connections occurs.

Figure 3:
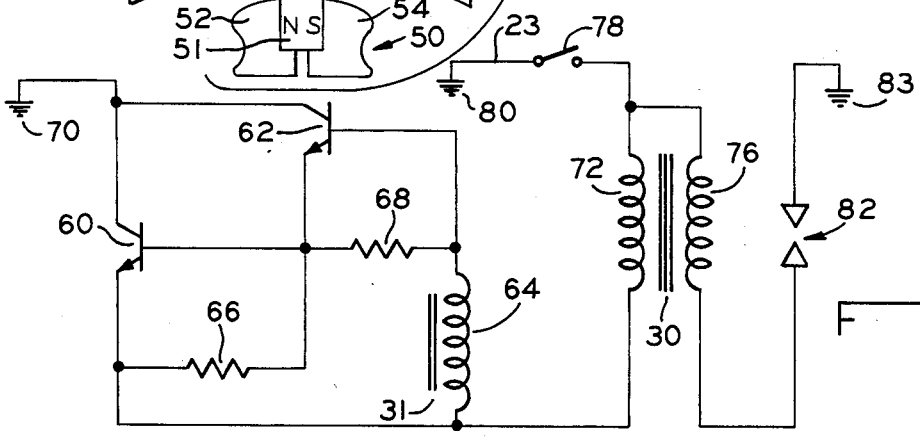
FIG. 3 is a schematic wiring diagram of an inductive ignition system which embodies the invention.

Referring now to FIG. 3, an inductive system is shown including a power transistor 60 and control transistor 62, a control coil 64, and two resistors 66 and 68. The ignition circuit is grounded by means of a ground connection 70. The system furthermore includes a primary coil 72 which is mounted on ferromagnetic core 30. Control coil 64 may be mounted on a separate core 31. A secondary coil 76 is shown which is inductively coupled to primary coil 72. A normally closed switch 78 is shown for connecting one side of primary coil 72 to a ground connection 80. A spark gap device 82 is connected in series across secondary coil 76 by way of ground connection 83.

The circuit of FIG. 3 operates as follows. The control circuit for power transisotr 60 includes transistor 62 and control coil 64. A bias voltage is generated in control coil 64 as the permanent magnet assembly 50 rotates past stator core 30. This forward bias voltage will turn on transistor 62 which in turn causes power transistor 60 to be turned on. The off biasing circuit for power transistor 60 includes the shunt circuit connected between the base and the emitter terminals of power transistor 60. When magnet assembly 50 moves past the stator pole end faces, a change in magnetic flux is established in the stator core 30 with the change of flux in the stator center leg 42 being first in one direction and then in the opposite direction. If the change of flux in the one direction is taken to be in the positive direction, and if the change of flux in the opposite direction is taken to be in the negative direction, then the change of flux in the center leg 42 during each cycle involves first a relatively slow increase from zero to a positive value, then a relatively rapid decrease from the positive value to a negative value, and then a relatively slow increase from the negative value back to the zero value. During the two periods of relatively slow increase, relatively low voltages are induced in primary coil 72 and in control coil 64. During the period of rapid decrease, however, relatively higher voltages are induced in coils 72 and 64, and the windings of these coils are arranged in such directions that, as viewed in FIG. 3, the upper end of each coil 64 and 72 is of a positive polarity relative to the lower end during the period of rapid flux change. Therefore, the voltage induced in control coil 64 during the period of rapid flux change biases transistor 62 to its on or conducting state and the voltage induced in the primary coil 72 establishes a forward collector-emitter current through the same transistor 62. Due to the fact that the control coil 64 is physically located on the center leg 42 of stator 30 or closer to the rotor than primary coil 72, the phase of the voltage induced in the control coil 64 is slightly ahead of the phase of the voltage induced in primary coil 72. Therefore, the voltage induced in the control coil 64 biases transistor 62 to its fully conducting state at an early point in the build up of induced voltage in coil 72, so that a maximum amount of power is contained in the system output. Both the voltage appearing across primary coil 72 and the current passing therethrough increase during the build up of induced voltage in the coil 72. At some point, transistor 62 will be turned off by the voltage generated in control coil 64 and this in turn will turn off transistor 60 thereby rapidly switching power transistor 60 to its non-conducting state and interrupting the flow of current through primary coil 72. This rapid change in current through coil 72 will cause a high voltage to be generated across secondary coil 76 thereby inducing a spark in spark gap device 82.

However, when normally closed switch 78 is opened, the conduction path for primary coil 72 is interrupted so that further current flow therethrough will not occur. Therefore, the engine will shut down and will not operate further.

Figure 4:
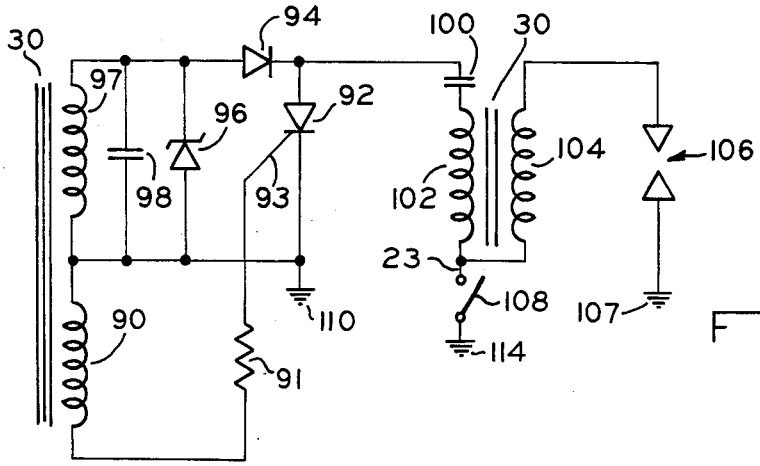
FIG. 4 is a schematic wiring diagram showing an alternative capacitor discharge ignition system which embodies the invention.

Referring now to the circuit of FIG. 4, the operation thereof is substantially similar to operation of the circuit of FIG. 1 except that a separate trigger coil 90 has been provided for SCR 92. A resistor 91 is interposed between gate 93 and trigger coil 90. Thus, referring to the circuit of FIG. 4, a capacitor 98 and zener diode 96 are connected across charging coil 97. A rectifier 94 completes the path from charging coil 97 through SCR 92. A storage capacitor 100 is provided in series with pimary coil 102. Secondary coil 104 is connected in series with spark gap device 106 by way of ground connection 107. A shut off switch 108 is provided in series with a ground connection 114. A ground connection 110 is also provided for SCR 92. Thus, charging coil 97 will generate alternating voltages which, during their positive half cycles, charge capacitor 100. During the negative half cycles, trigger coil 90 will cause SCR 92 to be gated on through resistor 91 and gate 93 which will cause discharge of storage capacitor 100 through primary coil 102 and switch 108 to ground 114, thereby generating high voltages in secondary 104 and causing a spark to be generated across spark gap device 106. When the end of primary coil 102 is lifted from ground by the opening of switch 108, further discharge of capacitor 100 is prevented.

However, if the engine has been running and now coasts to a stop by the opening of switch 108, magnet assembly 50 will continue to rotate as the engine slows down and will, therefore, generate further voltages in charging coil 97. These voltages are relatively high and will appear across SCR 92 and may therefore cause voltage breakdown of SCR 92. For this reason, zener diode 96 is connected across SCR 92 to prevent buildup of excessive voltage. Zener diode 96 is rated at the voltage which protects SCR 92. In one embodiment, zener diode 96 breakds down at 250 volts. SCR 92 will, however, continue to be triggered throguh trigger coil 90 and resistor 91 and will continue to discharge the relative low voltage existing across zener diode 96. Thus, voltages cannot build up as the engine coasts to a stop.

Thus, what has been provided is a very simple, fail-safe, and effective system for positively preventing current flow through the primary coil of an ignition system when a cut off switch is operated. As the engine coasts to a stop, there will be no significant voltage buildup in the circuit. Capacitor 100, being in series with coil 102 has been lifted from ground and cannot receive additional charge.

While this invention has been described as having a preferred design, it will be understood that it is capable of further modification. This application is therefore intended to cover any variations, uses, or adaptations of the invention, following the general principles thereof and including such departures from the present disclosure as come within known or customary practice in the art to which this invention pertains and fall within the limits of the appended claims.

What is claimed is:

1. An electronic ignition system for an internal combustion engine comprising:

a ferromagnetic core;

a plurality of coils mounted on said core and including a primary coil and a secondary coil which are inductively coupled by said core;

permanent magnet means rotatably mounted for movement past said core to induce varying flux densities therein;

an electronic switching circuit connected to said primary coil to control the current flow therethrough, said electronic switching circuit including an electronic switching device and a capacitor which is charged by the voltage developed by said moving permanent magnet in one of said plurality of coils and which is discharged through said electronic switching device;

a first ground connection for said electronic switching circuit;

a second ground connection for said primary coil; and a cut off switch connected between one end of said primary coil and said second ground connection, whereby, when said cut off switch is opened, current flow through said primary coil is prevented and triggering of said electronic switching device continues as the engine coasts to a stop.

2. The electronic ignition system according to claim 1 including a diode connected in circuit with said capacitor and elecrtronic switching device to complete the discharge path for said capacitor.

3. The electronic ignition system according to claim 1 wherein said first ground connection is made on said core.

4. The electronic ignition system of claim 1 wherein said second ground connection is made at a point removed from said core.

5. The electronic ignition system of claim 1 wherein said electronic switchign device is an SCR.

6. An electronic ignition system for an internal combustion engine comprising:

a core of ferromagnetic material;

a permanent magnet means adapted for movement past said core to induce cyclically varying magnetic flux therein;

a primary coil, a secondary coil, and a charge coil, mounted on said core;

an electronic switching circuit connected in circuit with said charging coil and said primary coil for providing controlled current flow through said primary coil;

a first ground connection for said electronic switching circuit; and a cut off switch having one side connected to said primary coil and the other side connected to a second ground connection, whereby current flow through said primary coil is prevented when said cut off switch is open.

7. The electronic ignition system according to claim 6 wherein said first ground connection is made on said core.

8. The electronic ignition system according to claim 6 whereins aid second ground connection is made at a point removed from said core.

9. The electronic ignition system according to claim 6 wherein said switching circuit comprises a capacitive discharge circuit including a capacitor, an electronic switch and a diode for providing a discharge path for said capacitor when said cut off switch is opened.

10. The electronic ignition system of claim 6 wherein said electronic switch is an SCR.

11. The electronic ignition system of claim 6 wherein said switching circuit is an inductive circuit.

12. An electronic ignition system for use with an internal combustion engine, said system comprising:

an electronic switching circuit including an electronic switching device and a storage capacitor;

a core of ferromagnetic material;

a charging coil mounted on said core and connected in circuit with said elecrtronic switching device;

transformer means including a ferromagnetic core, a primary coil and a secondary coil, said secondary coil adapted for connection to a spark gap device and said primary coil connected in series with said electronic switching device;

first grounding means for said electronic switching circuit, said grounding means being connected on said core; and a cut off switch having one end connected to a second grounding means located remotely from said core and a second end connected to said primary coil, whereby when said cut off switch is in the open position, current flow in said primary coil is interrupted while said electronic switching device continues to be triggered as the engine coasts to a stop.

13. The electronic ignition system of claim 12 including a diode in series circuit with said electronic switching device and said capacitor to complete a discharge circuit for said capactior.

14. The electronic ignition system of claim 12 wherein said electronic switching device is an SCR.

* * * * *

UNITED STATES PATENT AND TRADEMARK OFFICE

CERTIFICATE OF CORRECTION

PATENT NO. : 4,712,521
DATED : December 15, 1987
INVENTOR(S) : Kenneth W. Campen It is certified that error appears in the above-identified patent and that said Letters Patent is hereby corrected as shown below:

Col. 1, line 28, change "seconday" to --secondary--;
Col. 1, line 55, change "connections" to --connection--;
Col. 1, line 58, change "teh" to --the--;
Col. 2, line 54, change "thereofre" to --therefore--;
Col. 3, line 8, change "the" second occurrence to --The--;
Col. 3, line 66, change "throgugh" to --through--;
Col. 4, line 5, change "switchign" to --switching--;
Col. 4, line 16, change "or" to --for--;
Col. 4, line 18, change "conneciton" to --connection--;
Col. 5, line 8, change "fo" to --of--;
Col. 5, line 43, change "operaion" to --operation--;
Col. 5, line 45, change "alternative" to --alternating--;
Col. 6, line 24, change "transisotr" to --transistor--;
Col. 7, line 49, change "breakds" to --breaks--;
Col. 7, line 51, change "throguh" to --through--;
Claim 5, Col. 8, line 46, change "switchign" to --switching--;
Claim 8, Col. 9, line 2, change "whereins aid" to --wherein said--;

Signed and Sealed this

Ninth Day of August, 1988

*Attest:*

*Attesting Officer*

DONALD J. QUIGG

*Commissioner of Patents and Trademarks*